United States Patent [19]

Basiulis

[11] 4,147,206

[45] Apr. 3, 1979

[54] SEMI-ACTIVE TEMPERATURE CONTROL FOR HEAT PIPE HEAT RECOVERY UNITS

[75] Inventor: Algerd Basiulis, Redondo Beach, Calif.

[73] Assignee: Hughes Aircraft Company, Culver City, Calif.

[21] Appl. No.: 807,466

[22] Filed: Jun. 17, 1977

[51] Int. Cl.[2] ..... F28D 15/00

[52] U.S. Cl. ..... 165/32; 165/105; 165/DIG. 12

[58] Field of Search ..... 165/32, 96, 105, DIG. 12

[56] References Cited

U.S. PATENT DOCUMENTS

| | | | |
|---|---|---|---|
| 2,402,415 | 6/1946 | Kogel et al. | 165/105 X |
| 3,776,304 | 12/1973 | Auerbach | 165/105 X |
| 3,788,388 | 1/1974 | Barbmann | 165/32 |
| 3,893,506 | 7/1975 | Laing | 165/105 X |

*Primary Examiner*—Albert W. Davis, Jr.

*Attorney, Agent, or Firm*—Lewis B. Sternfels; W. H. MacAllister

[57] ABSTRACT

A selected number of heat pipes, located in the front rows of a plurality of otherwise operable heat pipes which are disposed between intake and exhaust ducts, have liquid-trap sections extending into a switching section. During normal operation, reservoirs in the switching section are dry and the plurality of heat pipes operate in a conventional manner. However, if some of the heat pipes in the exhaust dust become frosted over or otherwise too greatly cooled due to excessive cold in the intake duct, thermostatically or command-controlled valves or louvres cause the fluid stream in the exhaust duct to warm up or defrost the excessively cooled heat pipes therein. Prevention of excessive cooling is used to avoid frost build-up in air conditioning equipment, or solidification of solids and condensation of corrosive liquids.

4 Claims, 7 Drawing Figures

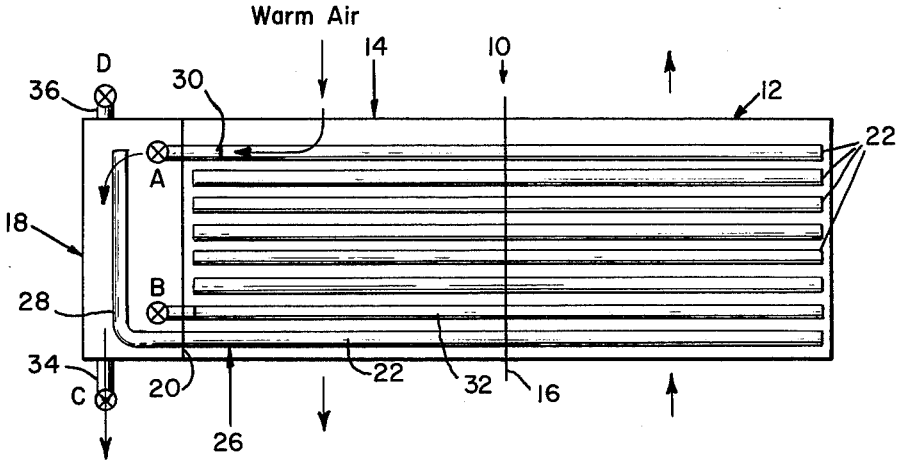
Fig. 3
Fig. 5
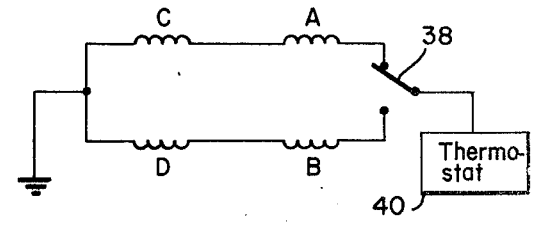
Fig. 3a.
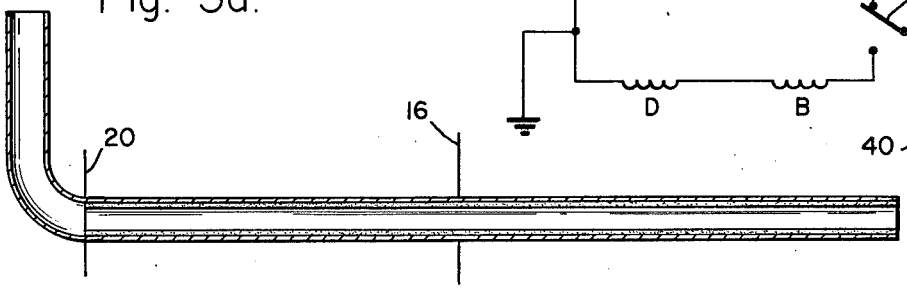
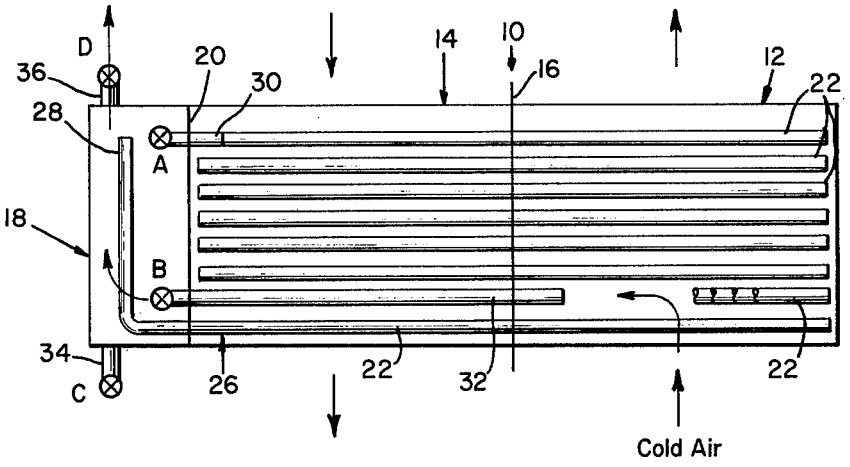
Fig. 4.
Fig. 4a.
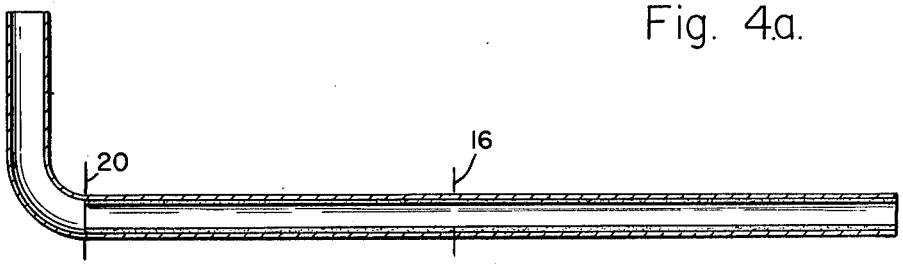

SEMI-ACTIVE TEMPERATURE CONTROL FOR HEAT PIPE HEAT RECOVERY UNITS

BACKGROUND OF THE INVENTION

1. Field of the Invention

The present invention relates to semi-active condensate and frost protection for heat pipe heat recovery units.

2. Description of the Prior Art

Heat pipes, which are used in heating and cooling applications in moderate and cold climates, are sometimes subject to the formation of frost. There have been several techniques which are directed to solving the frost formation problem. One technique utilizes externally powered electrical heaters which must be activated periodically to defrost the heat pipe units. In another technique, the heat pipe unit is periodically tilted in order to shut off heat transfer and, therefore, to permit warm air to defrost the heat pipes. While the latter system does not require external power for the heater, it does require power for tilting the heat recovery unit. A further technique reverses the heat pipes 180° to reverse the unit's flow path of warm exhaust.

Other protective devices are directed to prevention of freezing, solidification and condensation of other fluids, whether gaseous or liquid, such as corrosive liquids.

SUMMARY OF THE INVENTION

The present invention's approach in solving the above problem is to provide for a semi-active self-activating system. In general, thermostatically or command controlled valve or louvers are placed in a switching section which adjoins inlet and outlet ducts. A plurality of heat pipes extend between the ducts. Certain of the heat pipes have liquid-trap sections which extend into the switching section. During normal operation, reservoirs in the switching section are dry and the heat pipes operate in their conventional manner. When excessive frosting, solidification or other undesired condensation occurs, the switching valves or louvers are actuated to permit the relevant heat pipes to be warmed up and defrosted.

It is, therefore, an object of the present invention to provide for a semi-active frost, solidification and condensation protection for heat pipe heat recovery units.

Another object is to provide for an efficient yet simple frost, solidification and condensation protection mechanism.

Another object is to provide for minimum consumption of external power for frost, solidification and condensation protection purposes.

Other aims and objects as well as a more complete understanding of the present invention will appear from the following explanation of an exemplary embodiment and the accompanying drawings thereof.

BRIEF DESCRIPTION OF THE DRAWINGS

FIG. 3 depicts operation of the units shown in FIGS. 1 and 2 during one mode of operation thereof, with FIG. 3*a* showing one of the heat pipes therein;

FIG. 4 depicts the apparatus shown in FIGS. 1 and 2 in a second mode of operation, with FIG. 4*a* illustrating a single heat pipe therein; and FIG. 5 illustrates an electrical system for operating the switching operation of the present invention.

DESCRIPTION OF THE PREFERRED EMBODIMENT

Figure 1:
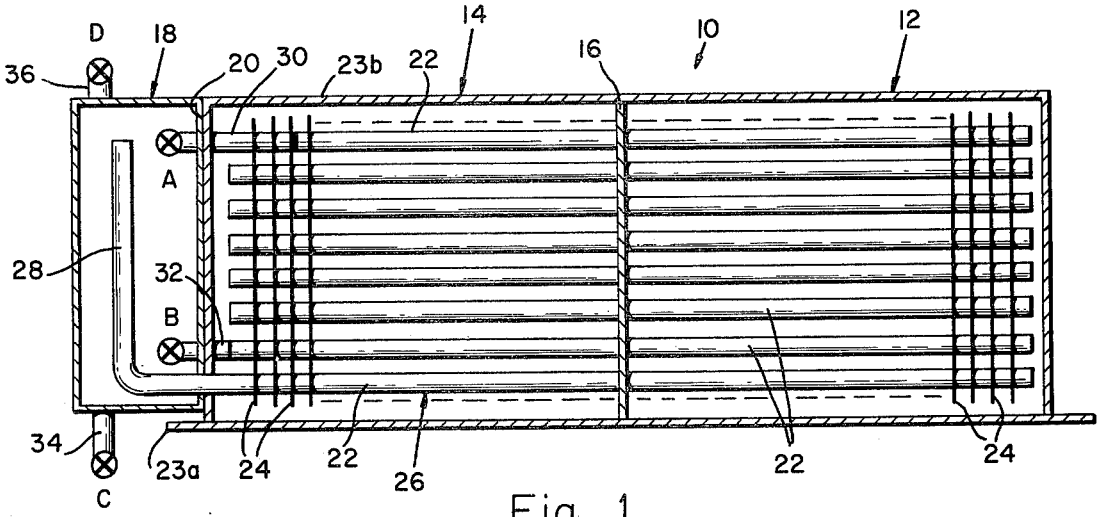
FIG. 1 depicts a top view of a plurality of heat pipes disposed within inlet and exhaust ports.
Figure 2:
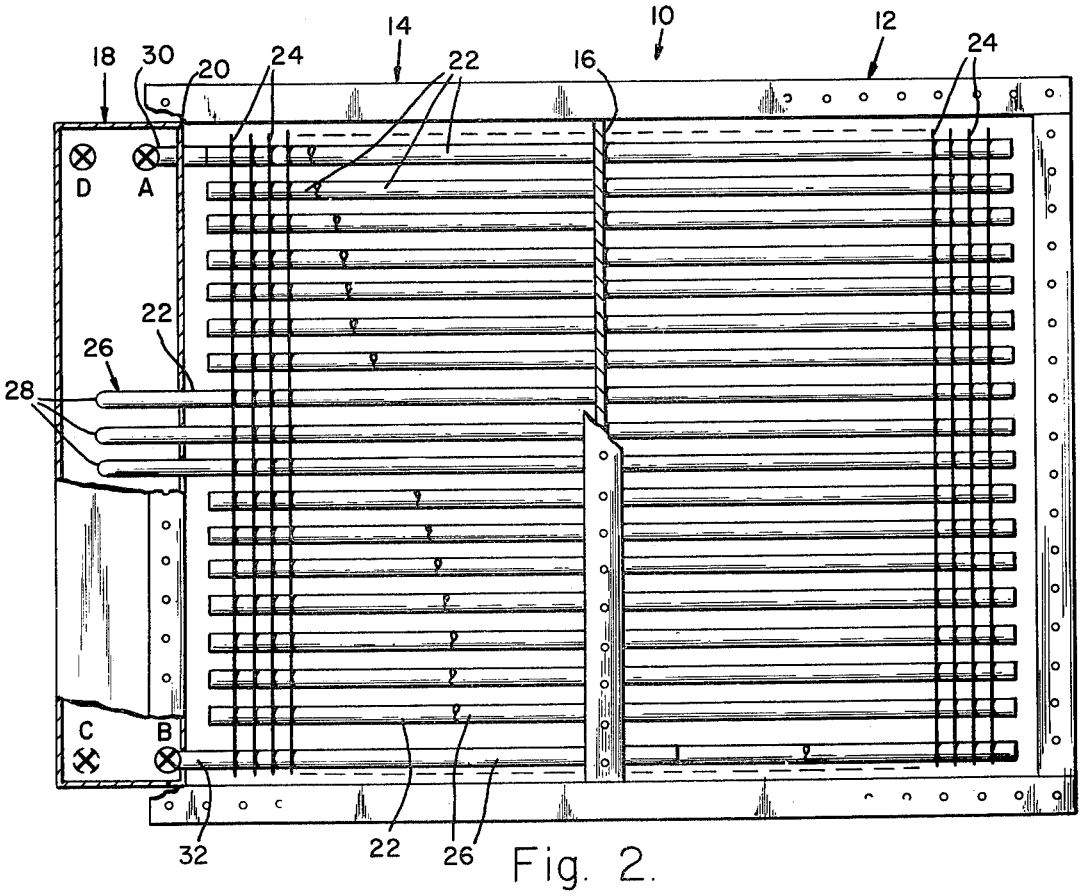
FIG. 2 is a front view of the apparatus shown in FIG. 1.

Referring to FIGS. 1 and 2, a heat pipe heat recovery unit 10 includes an air or fluid inlet section or portion 12 and an air or fluid exhaust portion 14 in a ducting system. Such a ducting system may be coupled to an inhabitable structure, such as a home, office or factory space, or in a processing industry where solids or liquids may be passed through the ducting. Portions 12 and 14 are separated by a plate 16. Attached to one of the portions is a switching section 18 which, as shown, is separated by a wall 20 from exhaust section 14.

Disposed within both section 12 and 14 and extending through plate or wall 16 are a plurality of heat pipes 22 arranged in rows extending transversely from the front 23*a* to the rear 23*b* of heat recovery unit 10. These heat pipes are constructed in a conventional manner with a two-phase working fluid therein and fins 24 are secured to the heat pipes for increasing thermal contact between the flowing air or fluid, also in a manner well known in the art.

In conformance with one of the features of the present invention, a plurality of the heat pipes described above, such as encompassed by front row 26, extends through wall 20 and into switching section 18. A portion 28 of each of the heat pipes in row 26 is curved into the switching section to act as liquid-traps. It is to be understood that succeeding rows may also have portions similar to portions 28 of row 26 for handling increasingly excessive and severe cooling conditions.

In addition to the specially extended heat pipes 26, there also exist two further communication conduits 30 and 32. Conduit 30 provides the means for communicating the fluid in section 14 with switching section 18 and has therein a valve A for effecting or preventing such communication. In a similar manner, conduit 32 provides a means by which the fluid in section 12 may be communicated to switching section 18, with a valve B also controlling this communication. Two further conduits 34 and 36 with respective valves C and D, extend respectively to the exterior of a habitable enclosure (valve C) and to the interior of the habitable enclosure (valve D).

As shown in FIG. 5, these valves are interconnected by a solenoid structure so that valves A and C operate together in a series connection and valves B and D operate together in another series connection, with the two series connections being coupled in parallel. The operation of one pair in series or the other is dependent upon the position of a switching arm 38 operated by a temperature activated controller 40. Thus, when switching arm 38 is shown in the position illustrated in FIG. 5, solenoids A and C are actuated to open valves A and C. Therefore, fluid in section 14 will flow to the exterior of the habitable enclosure past liquid-trap sections 28 of extended heat pipes 26. Conversely, when switch 38 is positioned otherwise so as to energize solenoids B and D valves B and D open so that air within section 12 is communicated through switching section 18 and past liquid-trap sections 28.

Operation of the system is illustrated in FIGS. 3 and 4. Normal operation is illustrated in FIGS. 3 and 3*a*.

Valve A is open. Hot air is drawn by the pressure differential which develops between valves A and C. The hot air keeps the working fluid in a super-heated state in liquid-trap sections 28 of switching section 18. The heat pipe outside of the switching section is fully saturated with working fluid, and operates normally.

When the outside air or fluid cools to a point where frost begins to form in section 12 or section 12 cools to solidify or condense fluids passing therethrough, the switching section is activated by thermostats or by other command. Valves A and C close, and valves B and D open. Cold air enters switching section 18, as shown in FIGS. 4 and 4*a*. The liquid-trap portions 28 cool down and trap most of the working fluid. The heat pipes 22 of row 26 and any succeeding rows which have portions similar to portions 28, are depleted of working fluid, and heat transfer stops from section 14 to section 12. The exhaust stream warms up, and defrosts or otherwise warms the heat pipes. As soon as the system is defrosted, for example, valves B and D close and valves A and C open, and heat pipe heat recovery unit 10 returns to normal operation.

While the above description is specific to a particular operation, the inventive technique can also be used to control the temperature of the intake air stream. For temperature-control applications, or for frost protection, the number switching heat pipes is determined by the design parameters dictated by climate conditions.

Although the invention has been described with reference to a particular embodiment thereof, it should be realized that various changes and modifications may be made therein without departing from the spirit of the scope of the invention.

What is claimed is:

1. A heat exchanger unit with temperature control comprising:

intake and exhaust ducts for transferring at least two flows of fluids in which a first of the fluids is subject to excessive cooling in a first of said ducts sufficient to effect deleterious cooling of a second of the fluids in a second of said ducts;

heat pipes with working fluid therein extending between said ducts for exchanging heat therebetween and between said first and second fluids;

working fluid trap portions coupled to at least a number of said heat pipes; and means coupled to said working fluid trap portions comprising an enclosure surrounding said working fluid trap portions with at least two couplings respectively between said enclosure and said intake and exhaust ducts, valves in said couplings, at least one outlet from said enclosure, and means coupled at least to said valves for maintaining a first of said valves open and a second of said valves closed, and vice-versa, whereby said number of said heat pipes are fully saturated with said working fluid in the absence of the excessive cooling and said working fluid is withdrawn from said number of said heat pipes and held in said working fluid trap portions during the excessive cooling.

2. A heat exchanger unit as in claim 1 wherein said heat pipes are arranged in rows extending along said ducts and in which said working fluid trap portions comprise extensions of said rows subject to the excessive cooling.

3. A heat exchanger unit as in claim 1 wherein said means coupled at least to said valves comprises a thermostat.

4. A heat exchanger unit as in claim 3 further comprising a pair of outlets respectively with valves extending from said enclosure, a first of said outlets and its valve and said first valve communicating through said enclosure with a first of said couplings and said first duct and a second of said outlets and its valve and said second valve communicating through said enclosure with a second of said couplings and said second duct, said first outlet valve and said first coupling valve having a first series connection and said second outlet valve and said second coupling valve having a second series connection, and said first and second series connections being coupled in parallel to said thermostat by a switching mechanism for respective energization of said first and second valve series connections.

* * * * *